US006092594A

United States Patent [19]

Palamara et al.

[11] Patent Number: 6,092,594

[45] Date of Patent: Jul. 25, 2000

[54] DEVICE FOR MAKING OR REGENERATING A WATER WELL

[75] Inventors: Francesco Palamara; Domenico Palamara; Sabina Palamara, all of Reggio Calabria, Italy

[73] Assignee: IDROPALM s.a.s. di Gattuso C. & Co., Reggio Calabria, Italy

[21] Appl. No.: 09/089,487

[22] Filed: Jun. 2, 1998

[51] Int. Cl.[7] ..... E21B 33/138; E21B 33/14; E21B 33/112

[52] U.S. Cl. ..... 166/55.1; 166/55.3; 166/177.4; 166/286; 166/298; 166/311

[58] Field of Search ..... 166/55, 55.1, 55.2, 166/55.3, 177.4, 286, 290, 297, 298, 311

[56] References Cited

U.S. PATENT DOCUMENTS

| | | | |
|---|---|---|---|
| 724,904 | 4/1903 | Mack | 166/55.3 |
| 958,517 | 5/1910 | Mettler | 166/55.1 X |
| 1,004,782 | 10/1911 | Hardison | 166/55.3 |
| 1,516,515 | 11/1924 | Batchlor | 166/55.3 |
| 1,785,419 | 12/1930 | Moss . | |
| 1,789,995 | 1/1931 | Barkis . | |
| 2,180,693 | 11/1939 | Reed | 166/55.3 |
| 2,381,929 | 8/1945 | Schlumberger . | |
| 2,638,801 | 5/1953 | Klassen et al. . | |
| 3,111,989 | 11/1963 | Tamplen | 166/55.3 |
| 3,346,049 | 10/1967 | Brown | 166/286 |
| 4,037,661 | 7/1977 | Ford | 166/311 |
| 4,158,388 | 6/1979 | Owen et al. | 166/286 |
| 4,640,362 | 2/1987 | Schellstede | 166/298 |
| 4,765,173 | 8/1988 | Schellstede | 166/55.2 X |
| 5,074,355 | 12/1991 | Lennon | 166/55.1 |

FOREIGN PATENT DOCUMENTS

| | | |
|---|---|---|
| 277802 | 11/1913 | Germany . |

*Primary Examiner*—George Suchfield
*Attorney, Agent, or Firm*—Browdy and Neimark

[57] ABSTRACT

A device for making or regenerating a water well, said well comprising a casing installed inside a borehole in the ground. The device comprises a operating head with angularly equispaced radial seats in which respective punch tools for forming holes, windows or shaped cuts in the wall of the casing are slidingly housable. The head is operated from the mouth of the well to a position at a preestablished depth inside the casing so that the radial seats are orthogonal to the wall of the casing. Operating means are integral with the head to axially move the tools inside the respective radial seats to and from the wall of the casing.

17 Claims, 4 Drawing Sheets

DEVICE FOR MAKING OR REGENERATING A WATER WELL

DESCRIPTION

1. Field of the Invention

The present invention relates to a device for making or regenerating water wells.

2. Background Art

As is known to the persons skilled in the field, the construction of water wells involves the carrying out of a number of operations in a precise time order which, with the currently available equipment, comprise the preparation of the fore well, the execution of the borehole and the lining of the borehole with blind pipes and filtering pipes. As filtering pipes, windowed pipes are used which are available on the market and are industrially manufactured in series, with a standardized filtering port composed of slots delimited by the wall of the pipe and by the edges of portions of the wall which are raised with respect to its perimetral profile. To ensure good filtering capacity, even with respect to the finest particulate, the cross section of the passage of standard windowed pipes is normally smaller than that which for each individual case would be optimal, thus decreasing the amount of water the well can deliver.

According to a very widely used technique, in order to prevent the percolation of pollutants in the aquifer formation from the strata above, a borehole of desired depth for the well is formed in successive steps, by cementing a first borehole and then making a new borehole in the cemented one with a smaller drill bit reaching a greater depth; the new borehole is then also cemented and so on, until reaching the desired depth. The cementing carried out in this manner does not, however, ensure adequate isolation, since, as a result of the vibrations induced by the formation of the various boreholes, the cement lining can yield or crack.

One of the greatest difficulties encountered in the construction of a well for potable water is the exact localization of the stratum in which the windowed pipes must be placed and the other operations, such as the formation of a draining layer in pebble gravel, must be carried out. The incorrect placement of the windowed pipes is a problem that is difficult and sometimes even impossible to resolve, and it very often leads to the abandonment of the well. Another inconvenience of the known techniques is the entrance of sand into the well as a result of an incorrect evaluation of the average granulometry of the aquifer formation.

It will also be appreciated that, according to the known techniques, building a well is extremely laborious and complex and, therefore, expensive, also due to the high consumption of materials and considerable downtime which, especially in the case of deep wells, must be expected.

SUMMARY OF THE INVENTION

The object of the present invention is to provide a device for making or regenerating water wells which makes it possible to avoid the above-mentioned inconveniences of the known techniques.

A particular object of the present invention is to provide a device of the above-mentioned type which makes it possible to form the filtering windows, with an aperture suited to the average granulometry of the terrain, directly on the already installed casing, and to ensure, in any case, the correct placement of the filtering surface of the pipe in the aquifer stratum as well as a filtering cross section of optimal size.

A further object of the present invention is to provide a device of the above-mentioned type which makes it possible to deliver a cementitious slurry or drainage materials to preestablished regions surrounding the filtering section of the casing, and allows for the reduced use of said materials and producing technically perfect results.

A further object of the present invention is to provide a device of the above-mentioned type which makes it possible to regenerate existing wells which are either on their way to being exhausted due to a variation of the level of the aquifer formation or which have been abandoned because of incorrect placement of the filtering section or breakage or damage of the casing.

These objects have been achieved with the device for making or regenerating water wells according to the present invention whose main feature is that it comprises a operating head with angularly equispaced radial seats in which respective punch tools for forming holes, windows or shaped cuts in the wall of the casing are slidingly housable, means for driving said operating head from the mouth of the well to a position at a preestablished depth inside the casing so that the radial seats are orthogonal to the wall of the casing itself and operating means integral with the operating head to axially move the punch tools to and from the wall of the casing, within the respective radial seats.

Different types of punch tools can be mounted in an interchangeable way on the operating head. Said tools are suited in particular to form filtering windows on the casing, or to form passages through the casing for dispensing cementitious slurry, drainage gravel or other useful materials to the hollow space between the casing and the wall of the hole.

In one preferred embodiment of the invention, the punch tools are moved by means of a slider which is slidable inside the operating head in a direction orthogonal to the axes of the tools. The tools are slidingly connected to the slider according to inclined directions with respect to the sliding axis of the slider and converge at a common point on said axis, so that an axial movement of the slider produces a corresponding axial sliding of the punches in an orthogonal direction.

DESCRIPTION OF THE DRAWINGS

Further characteristics and advantages of the device for forming or regenerating water wells according to the present invention will be apparent from the following description of one of its possible embodiments given as an example and not limitative with reference to the attached drawings in which.

DESCRIPTION OF THE BEST MODE OF CARRYING OUT THE INVENTION

Figure 1:
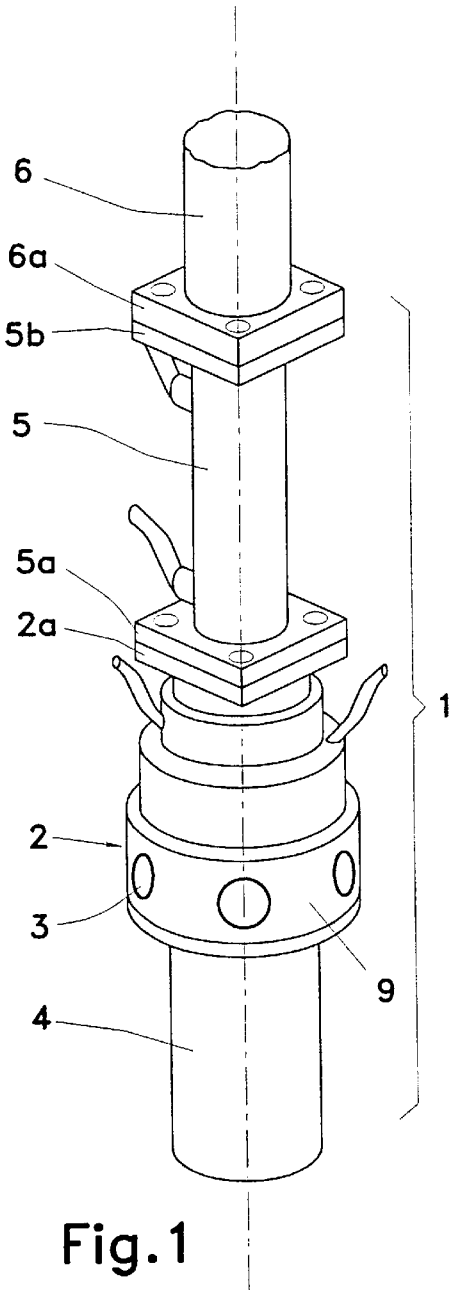
FIG. 1 is a perspective view of the device according to the invention.

With reference to the above-mentioned figures, the device according to the invention is generally indicated with 1 in FIG. 1 and comprises a substantially cylindrical operating head 2, on the side surface of which radial tubular seats 3 are formed which are spaced at equal angular distance from one another, as well as an actuating device 5 axially extending from the operating head and fixed to head 2 by means of respective connection flanges 2*a* and 5*a*. Actuator 5 is in turn axially fixed to a operating rod 6 by means of respective connection flanges 5*b* and 6*a*.

Figure 2:
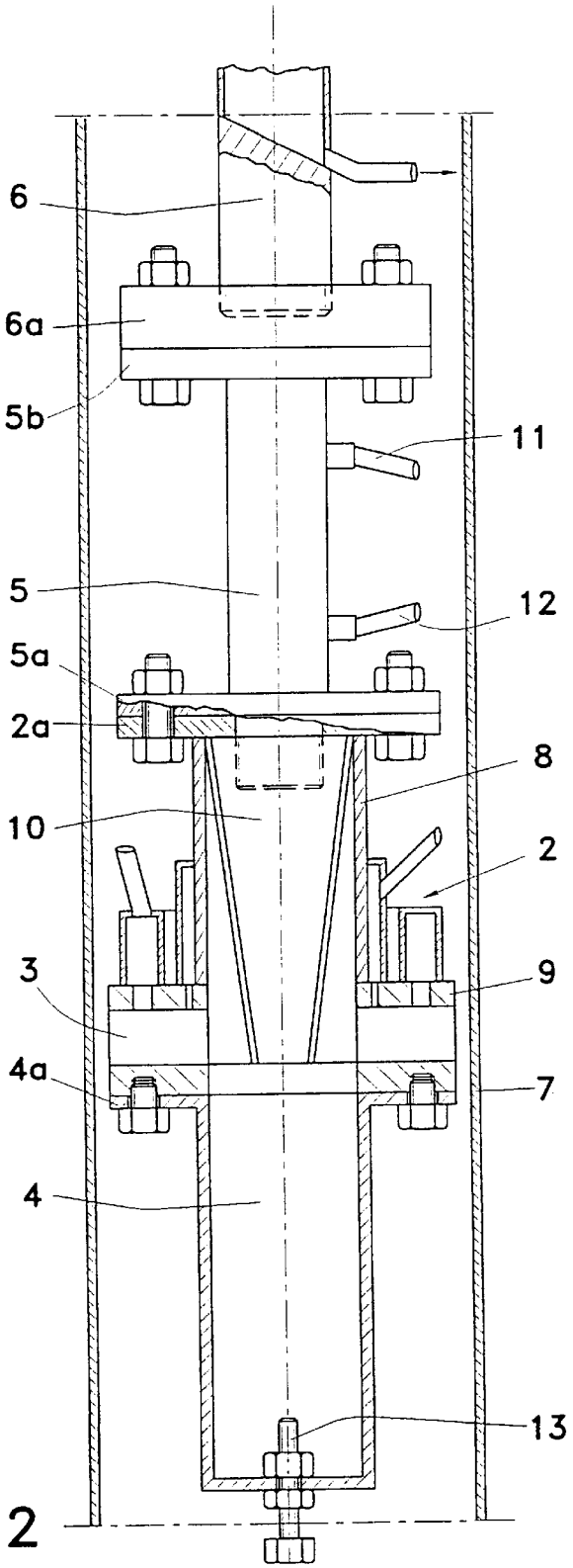
FIG. 2 is a longitudinal cross sectional view of the device of FIG. 1, installed inside a casing.

The device according to the invention is shown in greater detail in FIG. 2 wherein it is illustrated inside a casing 7 of a well. With particular regard to operating head 2, it is composed of a tubular body 8 coaxial to the axis of the device, connected at one end to actuator 5 and having in correspondence with the other end an annular expansion 9 wherein radial seats 3 are formed, communicating with the inside of tubular body 8. From the opposite end of the body, the annular expansion 9 has a tubular housing 4 which is coaxial with, and of equal internal diameter to, tubular body 8 and is fixed to annular expansion 9 through a flanged end 4*a*.

A slider 10 integral with the piston rod of actuator 5 is slidingly mounted inside tubular body 8. The actuator is of a double-acting type, ducts 11 and 12, respectively for the feeding and the discharge of an actuating fluid, being provided. In this way, slider 10 can slide in both directions inside tubular body 8 and in housing 4 which is aligned thereto, between two run-end positions, a first one determined by its abutment with flange 2*a* and a second one by its abutment with an adjustment screw 13 located on the bottom of housing 4, by means of which it is possible to sharply adjust the maximum run of slider 10.

Figure 4:
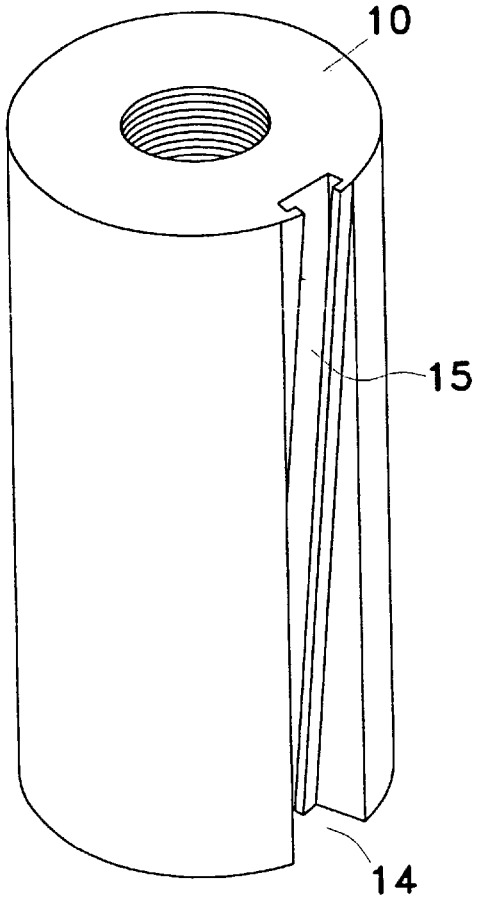
FIG. 4 is a simplified view of the tool operating slider.
Figure 5:
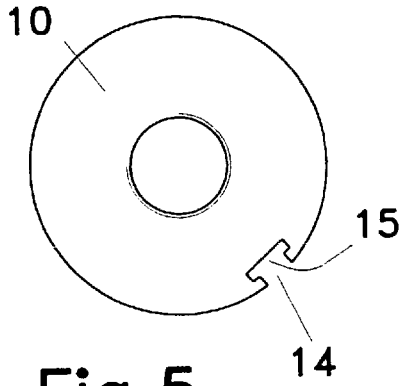
FIGS. 5 and 6 are respectively top plan and bottom plan views of the slider of FIG. 4.
Figure 6:
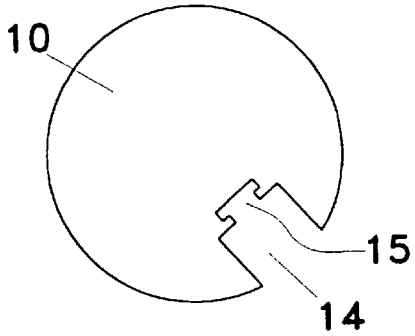
Figure 7:
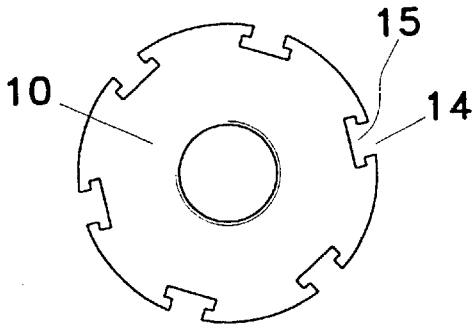
FIGS. 7 and 8 are respectively top plan and bottom plan views of a six-grooved slider.
Figure 8:
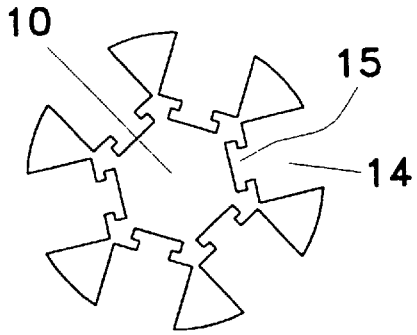

As more clearly shown in FIGS. 4 to 8, slider 10 has angularly spaced longitudinal grooves 14 on its surface (in FIGS. 4 to 6 only one groove is indicated for simplicity). Each groove 14 increases in depth from one end of slider 10 to the other, and a substantially T-shaped channel 15 is formed on the bottom of each groove.

Figure 9:
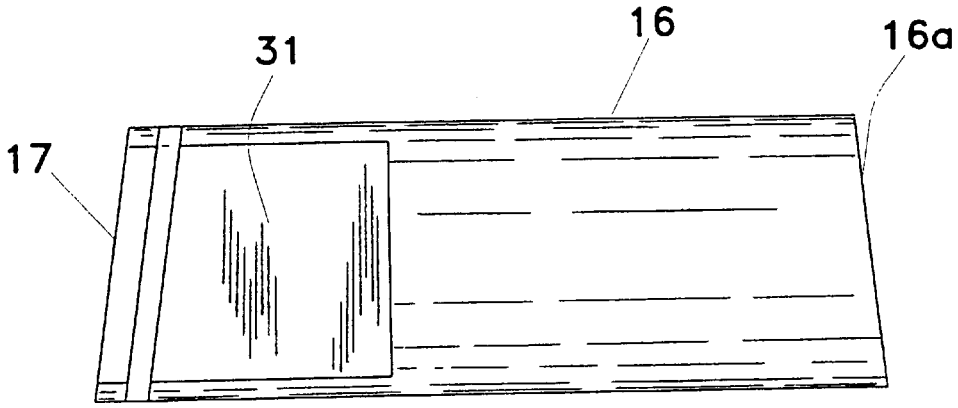
FIGS. 9 and 10 are longitudinal views, according to two directions orthogonal to one another, of a punch tool which can be used with the device according to the invention.
Figure 10:
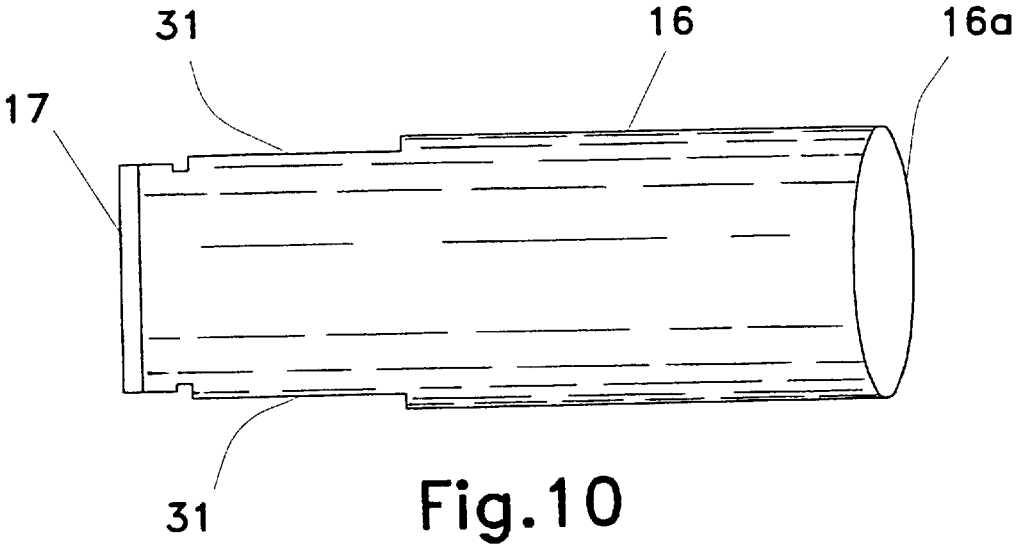

The number of grooves 14 formed along slider 10 depends on the diameter of the slider itself and, correspondingly, of operating head 2. In any case, the number of grooves 14 is equal to the number of radial seats 3 formed in operating head 2, and each groove 14 is formed in correspondence with one of said radial seats 3. In these seats, special punch tools of different forms, in accordance with the function they have to perform, are slidingly mounted. One of these tools is shown in a longitudinal view in FIGS. 9 and 10 and is indicated at 16. It is designed to form special windows on the surface of the casing and, for that purpose, it has an oblique cutting end 16*a*, whereas the opposite end has a substantially T-shaped protrusion 17 with the same cross section as channel 15 formed on the bottom of grooves 14 of slider 10. T-shaped protrusion 17 has the same inclination as the bottom of grooves 14, so that, engaging it inside a corresponding channel 15, tool 16 is restrained to slide with respect to slider 10. Since tool 16 is in turn forced to slide inside corresponding radial seat 3, and as a consequence of the inclination of channels 15 with respect to the axis of slider 10, it slides forward and backward in respective radial seat 3 following a corresponding axial sliding of slider 10 inside tubular body 8 of operating head 2 driven by actuator device 5.

On the body of each tool 16, in proximity to the T-shaped protrusion, two flattened portions 31 are formed on diametrically opposite sides, reducing the cross section of the tool to a width equal to that of groove 14 in order to allow it to slide inside the groove. The axial length of said flattened portions 31 is at least equal to the maximum depth of groove 14 in order to prevent size interferences during the sliding of slider 10.

Figure 3:
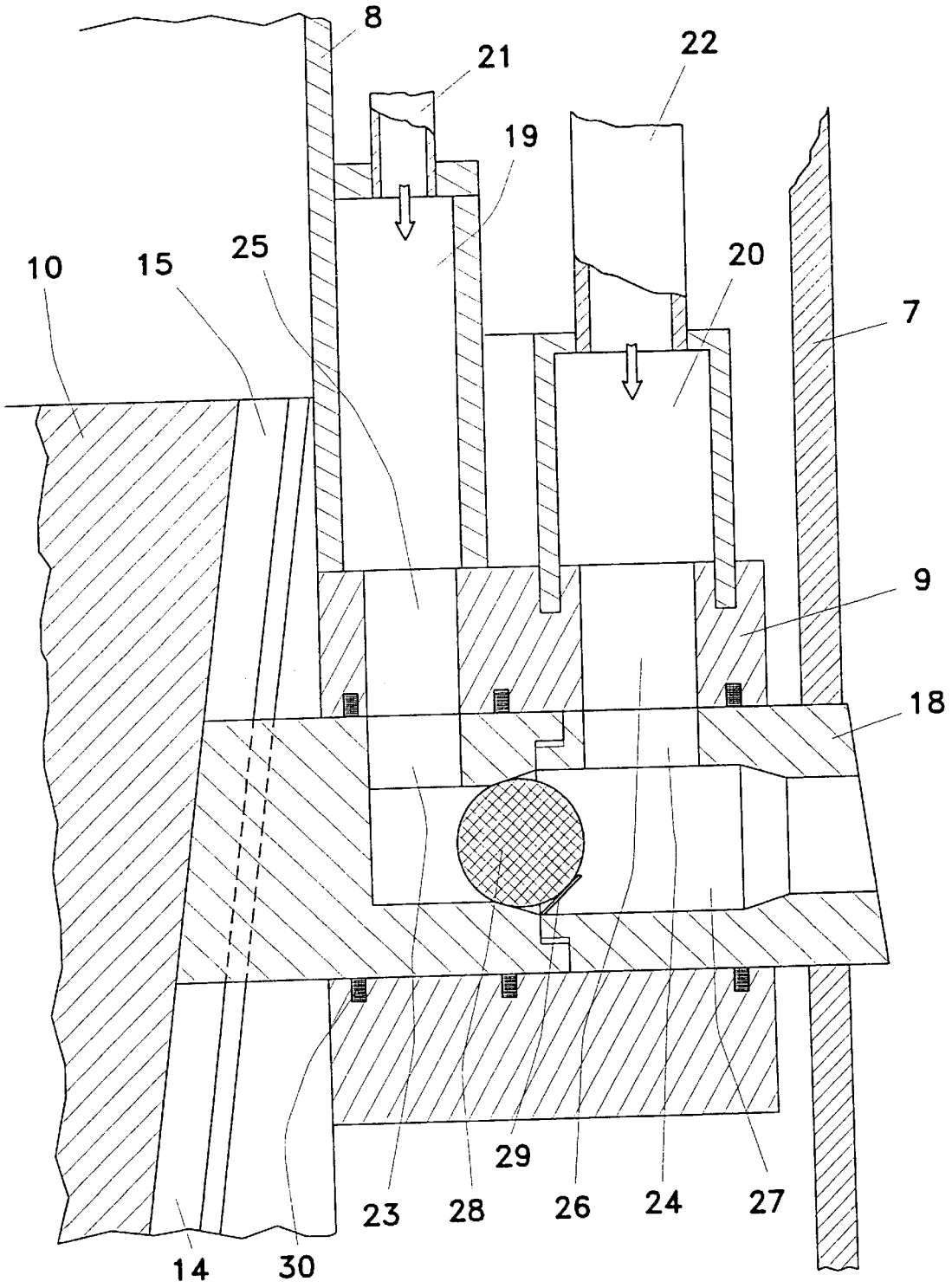
FIG. 3 is an enlarged longitudinal cross sectional view of a portion of the operating head of the device according to the invention on which a material dispensing punch tool is mounted.

FIG. 3 shows an enlarged view of a portion of operating head 2 on which a hollow tool 18 is mounted, usable for the cementing of the well as will be described hereinafter. The use of hollow tool 18 requires that operating head 2 has a couple of annular chambers 19 and 20 formed above annular expansion 9 and coaxial to tubular body 8 of operating head 2. The two chambers 19 and 20 communicate by means of ducts 21 and 22 with respective feeding means of water and fluid cementitious slurry external to the well.

The run carried out by tool 16 or 18 is determined by the inclination of channel 15 and by the run of slider 10. The maximum extension of the tool out of corresponding seat 3 must allow the tool to carry out the desired operation (hole, window or cut of various types) on the wall of casing 7. During its sliding, slider 10 progressively enters housing 4 until it reaches the bottom end of its stroke which is determined by adjustment screw 13.

Tool 18, shown in FIG. 3, makes ballasting and cementing possible as well as the passage of water or any other material necessary to work in the hollow space between the casing and the hole. For that purpose, on tool 18, two radial passages 23 and 24 are formed which, when the tool is in its position of maximum extension from seat 3, are aligned with corresponding discharge ducts 25 and 26 formed on annular expansion 9 of operating head 2 in correspondence with chambers 19 and 20. In this way, the chambers are put in communication with internal chamber 27 of tool 18.

In the embodiment shown in FIG. 3, tool 18 is made in two portions screwed to one another to allow for all the lathe machining of the internal surfaces. In fact, internal chamber 27 of tool 18 has a widened intermediate portion filleted with the two end portions of smaller width by means of frusto-conical wall portions. A spherical plug 28 having a diameter substantially equal to that of the portions of chamber 27 with a smaller diameter closes the communication between the two chambers 19 and 20 for water and cementitious slurry, respectively, with plug 28 being held in position by means of a flexible laminar member 29 protruding from the wall of chamber 27 in correspondence with the point of connection between the two halves of tool 18. In this way, when tool 18 is used to inject cementitious slurry outside casing 7, the pressure of the mixture is sufficient to maintain plug 28 in the position of closure shown in FIG. 3. When, at the end of the injection of the cement slurry, it is necessary to wash the duct and chamber 20, high pressure water is fed to chamber 19 via duct 21 which overcomes the elastic resistance of laminar member 29 pushing plug 28 to the opposite side of the widened portion of chamber 27, thus putting in communication the water duct with the duct of the cement slurry to be washed. It will be appreciated that the pressure of the water let in must be very high to be able to push the material which is placed along entire access duct 22 back to the mouth of the well. Suitable seals 30 are provided inside radial seats 3.

Advantageously, operating rod 6 is of a tubular form so that it can function as a manifold for the material such as the pebble gravel to be fed to the operating head.

The device according to the present invention makes it possible to carry out in situ a series of operations for the realization of a well which is currently impossible according to prior art methods, while drastically decreasing costs and construction time and significantly increasing the possibilities of using the well for the purposes for which it is intended. With the device according to the invention, the procedure for building a well can be the following:

a) a borehole is made to the desired depth with any known method;

b) the casing only comprising blind pipes and a bottom plug is installed;

c) the investigations necessary for a correct stratigraphy are carried out for the purpose of identifying the aquifer stratum or strata to be used and, possibly that or those to be obstructed;

d) the pH of the bentonite sediments is corrected, bringing it to a value adequate to avoid the corrosion of the pipes over time;

e) the roof and the bed of the aquifer stratum or strata to be put in production and the aquifer stratum or strata to be obstructed are cemented, as are the hollow spaces between the casing and the hole for a depth which goes from the mouth of the well to a preestablished project point;

f) windows are formed in the pipes placed at the height of the stratum or strata to be put in production with openings gauged according to the plan, leaving the bentonite muds remaining in the hollow space between the casing and the hole among the various cements in order to ensure perfect hydraulic isolation;

g) the well is put in production.

The device according to the present invention makes it possible, therefore, to carry out the following operations:

1. windows of any size and form, placed with precision in preestablished points and with an opening of the filtering surface corresponding to the plan, thanks to the possibility of a micrometric adjustment of the extension of slider 10;

2. cementing behind the casing in any necessary point, above-all in order to isolate the aquifer stratum or strata from possible infiltration of pollutants;

3. placement of gauged pebble gravel at the desired depth (by means of a pressurised feeding created by hydraulic means) to create the draining layer according to the needs, carefully regulating the height with respect to the aquifer water level, with clear savings in material that is impossible with known methods;

4. restoration of piping portions which for various reasons (corrosion, breakage, etc.) could make the well unusable; this is possible, by punching with suitable tools, mounted in seats 3 of operating head 2, the entire length that is to be regenerated, while keeping it from collapsing, and then using new pipes which are made to adhere to the upper and lower ends of the old pipes, or portions of the same, by means of punching, with a limited reduction of the cross section of the well.

In particular, the operation of forming windows is easier and faster the more tools are provided on operating head 2. In use, a operating head with six tools is considered particularly adequate, since it allows to open six windows at a time and a small angular or axial shifting is sufficient to prepare the device for the forming of six more windows adjacent to the previous ones or at a different level from the same. A goniometer and a measuring chord are associated to the device according to the invention making it possible to carry out the above-mentioned movements with the desired precision.

In cases in which it is necessary to operate with only one tool which produces a single, sufficiently large hole for access to the hollow space, a slider with correspondingly sized grooves must be used and the unused passages for the water and cement mortar must be closed.

The operation of the tools by means of slider 10 ensures the maximum reliability of continuous functioning for the back and forth movement of the tools which can be subjected to very high loads in the absence of springs.

A particularly advantageous feature of the device according to the invention consists in its high operational speed both in the execution of building works as well as in the restoration of wells. In fact, it is characterized by the fact that it makes it extremely easy to access the hollow space between the casing and the borehole wall to carry out necessary operations as well as to quickly close the passage again. In this way, it is possible to restore the quo ante state of the stratification broken during the formation of the hole and, therefore, to inhibit the phenomenon of percolation and intercommunication between the strata which is the main cause of pollution.

The device according to the present invention can be easily disassembled for normal maintenance and substitution of tools. While a circular cross section of the operating head 2 is the easiest to conceive of, it is clear that, for the purposes of the invention, a polygonal cross section can also be used.

Finally, it will be appreciated that, for the operating of actuator 5 which operates slider 10, the amount of oil to be used is minimal. This makes it possible to construct a radio controlled oleodynamic unit in a small space and on the device itself while avoiding connection on the surface to a flexible pipe having a high pressure and considerable length.

Variations and/or modifications can be brought to the device for realizing wells according to the present invention without departing from the scope of the invention itself as defined in the attached claims.

What is claimed is:

1. Device for making or regenerating a water well, the well comprising a casing installed inside a borehold in the ground, comprising an operating head with angularly equispaced radial seats in which respective punch tools for forming holes, windows or shaped cuts in the wall of the casing are slidingly housable, means for driving said operating head from the mouth of the well to a position at a preestablished depth inside the casing so that the radial seats are orthogonal to the wall of the casing, and operating means integral with said operating head to move said tools within the respective radial seats to and from the wall of the casing, wherein the operating means of said tool comprise a slider mounted inside said head and slidable in a direction orthogonal to the axes of said seats, said tools being slidingly connected to said slider according to respective directions inclined with respect to the sliding axis of the slider and converging at a common point on said axis, operating means being provided for moving said slider, so that the axial sliding of the same in either direction causes a corresponding orthogonal sliding of said tools inside the respective seats, wherein at least one axial groove is formed on the external surface of said slider, having a depth which increases from one end to the other of the slider as well as a substantially T-shaped channel at its bottom, within which a correspondingly shaped end of a respective tool is slidingly engaged.

2. Device according to claim 1, wherein a plurality of equispaced axial grooves is formed on the surface of said slider.

3. Device according to claim 2, wherein said tools have, in proximity to said shaped end, two diametrically opposed flattened portions, the distance between said portions being equal to the width of said grooves and their length being at least equal to the depth of said grooves.

4. Device according to claim 2, wherein each of said punch tools has an inner chamber open on the side of the cutting end, and said operating head comprises two additional chambers communicating with said tool chamber for dispensing fluids to the outside of said casing, said head chambers communicating with feeding means located outside the well.

5. Device according to claim 1, wherein said tools have, in proximity to said shaped end, two diametrically opposed flattened portions, the distance between said portions being equal to the width of said grooves and their length being at least equal to the depth of said grooves.

6. Device according to claim 1, wherein each of said punch tools has an inner chamber open on the side of the cutting end, and said operating head comprises two additional chambers communicating with said tool chamber for dispensing fluids to the outside of said casing, said head chambers communicating with feeding means located outside the well.

7. Device for making or regenerating a water well, the well comprising a casing installed inside a borehold in the ground, comprising an operating head with angularly equispaced radial seats in which respective punch tools for forming holes, windows or shaped cuts in the wall of the casing are slidingly housable, means for driving said operating head from the mouth of the well to a position at a preestablished depth inside the casing so that the radial seats are orthogonal to the wall of the casing, and operating means integral with said operating head to move said tools within the respective radial seats to and from the wall of the casing, wherein each of said punch tools has an inner chamber open on the side of the cutting end, and said operating head comprises two additional chambers communicating with said tool chamber for dispensing fluids to the outside of the casing, said head chambers communicating with feeding means located outside the well.

8. Device according to claim 7, wherein the operating means of said tool comprise a slider mounted inside said head and slidiable in a direction orthogonal to the axes of said seats, said tools being slidingly connected to said slider according to respective directions inclined with respect to the sliding axis of the slider and converging at a common point on said axis, operating means being provided for moving said slider, so that the axial sliding of the same in either direction causes a corresponding orthogonal axial sliding of said tools inside the respective seats.

9. Device according to claim 2, wherein said operating head comprises a tubular body with an intermediate annular expansion in which said radial seats are formed, said slider being slidingly mounted inside said tubular body.

10. Device according to claim 9, wherein said slider has grooves thereon, and said tools have, in proximity to said shaped end, two diametrically opposed flattened portions, the distance between said portions being equal to the width of said grooves and their length being at least equal to the depth of said grooves.

11. Device according to claim 9, wherein each of said punch tools has an inner chamber open on the side of the cutting end, and said operating head comprises two additional chambers communicating with said tool chamber for dispensing fluids to the outside of said casing, said head chambers communicating with feeding means located outside the well.

12. Device according to claim 8, wherein said slider has grooves thereon, and said tools have, in proximity to said shaped end, two diametrically opposed flattened portions, the distance between said portions being equal to the width of said grooves and their length being at least equal to the depth of said grooves.

13. Device according to claim 8, wherein each of said punch tools has an inner chamber open on the side of the cutting end, and said operating head comprises two additional chambers communicating with said tool chamber for dispensing fluids to the outside of said casing, said head chambers communicating with feeding means located outside the well.

14. Device according to claim 7, wherein said head chambers are in communication respectively with pressurised water feeding means and fluid cementitious slurry feeding means, and in which two radial passages are provided through said tools to connect the tool chamber with the head chambers when said tools are in the run end position farthest from the axis of the slider, means being provided for closing the passages inside said tool chamber in order to prevent communication between the two head chambers when said tools are delivering said slurry, as well as to connect said head chambers when pressurised water must be sent inside the relevant head chamber and its relative conduits to wash it.

15. Device according to claim 14, wherein said slider has grooves thereon, and said tools have, in proximity to said shaped end, two diametrically opposed flattened portions, the distance between said portions being equal to the width of said grooves and their length being at least equal to the depth of said grooves.

16. Device according to claim 7, wherein said slider has grooves thereon, and said tools have, in proximity to said shaped end, two diametrically opposed flattened portions, the distance between said portions being equal to the width of said grooves and their length being at least equal to the depth of said grooves.

17. Device for making or regenerating a water well, the well comprising a casing installed inside a borehold in the ground, comprising an operating head with angularly equispaced radial seats in which respective punch tools for forming holes, windows or shaped cuts in the wall of the casing are slidingly housable, means for driving said operating head from the mouth of the well to a position at a preestablished depth inside the casing so that the radial seats are orthogonal to the wall of the casing, and operating means integral with said operating head to move said tools within the respective radial seats to and from the wall of the casing, wherein the operating means of said tools comprise a slider, and said tools have, in proximity to said shaped end, two diametrically opposed flattened portions, the distance between said portions being equal to the width of grooves on said sliders, and their length being at least equal to the depth of said grooves.

* * * * *